US007347269B2

(12) United States Patent
Layton

(10) Patent No.: US 7,347,269 B2
(45) Date of Patent: Mar. 25, 2008

(54) FLOW TUBE EXERCISING TOOL

(75) Inventor: Benny C. Layton, Okmulgee, OK (US)

(73) Assignee: Baker Hughes Incorporated, Houston, TX (US)

( * ) Notice: Subject to any disclaimer, the term of this patent is extended or adjusted under 35 U.S.C. 154(b) by 94 days.

(21) Appl. No.: 11/415,518

(22) Filed: May 2, 2006

(65) Prior Publication Data

US 2007/0062687 A1 Mar. 22, 2007

Related U.S. Application Data

(63) Continuation-in-part of application No. 11/131,726, filed on May 18, 2005.

(51) Int. Cl.
*E21B 43/12* (2006.01)

(52) U.S. Cl. ..... 166/332.1; 166/332.5

(58) Field of Classification Search ..... 166/332.1, 166/332.5

See application file for complete search history.

(56) References Cited

U.S. PATENT DOCUMENTS 4,273,194 A * 6/1981 Pringle et al. ..... 166/323
4,624,315 A * 11/1986 Dickson et al. ..... 166/323
4,796,705 A * 1/1989 Carmody et al. ..... 166/323
5,167,284 A * 12/1992 Leismer ..... 166/374
6,273,187 B1 8/2001 Voisin, Jr. et al. ..... 166/63

* cited by examiner

*Primary Examiner*—Frank Tsay
(74) *Attorney, Agent, or Firm*—Shawn Hunter

(57) ABSTRACT

A flow tube exercising tool and method for use are described for actuating the flow tube of a downhole safety valve in order to remove build ups of scale and debris from the safety valve and ensure proper operation. The exercising tool provides a lower engagement portion that underlies the lower end of the safety valve flow tube so that upward movement of portions of the exercising tool will move the flow tube upwardly. An upper engagement portion overlies the upper end of the flow tube so that downward movement of portions of the exercising tool will move the flow tube downwardly. Only a single trip of the flow tube exercising tool is necessary to accomplish multiple upward and downward movements of the flow tube.

18 Claims, 5 Drawing Sheets

FLOW TUBE EXERCISING TOOL

This application is a continuation-in-part to U.S. patent application Ser. No. 11/131,726 filed May 18, 2005.

BACKGROUND OF THE INVENTION

1. Field of the Invention

The invention relates generally to methods and devices for cleaning and remediating a subsurface safety valve or other downhole tool having a sliding flow tube member.

2. Description of the Related Art

Flapper-type valves are often used as safety valves within wells to selectively close off production. The usual flapper valve uses a torsion spring to bias the valve member toward a closed position. During normal operation, however, the flapper member is retained in an open position by an axially moveable flow tube. When the flow tube is moved upwardly within the production tubing, the flapper member is permitted to close under influence of the spring. To reopen the valve, the flow tube is moved downwardly within the production tubing to urge the valve back towards its open position.

One problem that has traditionally been faced by valves of this type is that scale, dirt, and other debris will often build up within the production tubing during typical production operations. This build up can render the safety valve partially or completely inoperable. The most deleterious build up will be that which occurs on and around the flow tube that is used to open the valve, making the flow tube difficult to physically move upwardly and downwardly. Additionally, the flapper mechanism may be encrusted with scale and other debris making it less likely to fully close when necessary. This means that the valve will be unable to function well in the event of an emergency requiring production flow to be closed off.

U.S. Pat. No. 6,273,187, entitled "Method and Apparatus for Downhole Safety Valve Remediation," describes a technique for removing scale and debris build up using explosive charges. The use of explosives, however, carries with it risks of damage to wellbore valve components as well as the potential for a breach of the production tubing string.

The harmful effects of scale and debris build up can be prevented and reduced by exercising the safety valve, through operation of its components, before the build up has reached a point where the safety valve is no longer fully operational. In the past, this has been accomplished using a gripping tool having mechanical slips that are set against the inside of the flow tube. Once the slips are set, the gripping tool can be pulled upwardly to move the flow tube upwardly or jarred downwardly to move the flow tube downwardly. Unfortunately, tools of this type tend to physically damage the flow tube and other wellbore components, due to the use of the slips.

The parent application to this one describes a flow tube exercising tool that is used in conjunction with the hydraulic controller of a safety valve to move the flow tube axially upwardly and downwardly in order to remove build ups of scale and debris from the safety valve and ensure proper operation. This exercising tool provides an engagement portion that underlies the lower end of the safety valve flow tube so that upward movement of the exercising tool will move the flow tube upwardly. Hydraulic fluid is provided to the hydraulic controller to move the flow tube downwardly. This exercising tool represents a significant improvement over the prior art. However, there may be instances wherein this type of flow tube exerciser is not practical. One example would be an instance where the flow tube of the safety valve is not controllable hydraulically.

The present invention addresses the problems of the prior art.

SUMMARY OF THE INVENTION

The invention provides an improved flow tube exercising tool and method of use. An exemplary flow tube exercising tool is described that features a mandrel having upper and lower engagement portions that will overlie and underlie the upper and lower ends of the flow tube, respectively. The flow tube exercising tool is run into a production tubing string using a running tool. The tool is landed onto a safety valve within the tubing string. Further downward force upon the exercising tool will cause the upper and lower engagement portions to engage the upper and lower ends, respectively, of the flow tube of the safety valve.

In a currently preferred embodiment, the flow tube exercising tool includes an inner mandrel and an outer mandrel that are axially moveable with respect to one another, and initially releasably affixed to one another via a shear member. The outer mandrel carries a stop shoulder that is shaped and sized to abut a landing shoulder within the tubing string that is associated with the safety valve. After the tool is landed in this manner, fluid pressure is increased above the tool within the tubing string to shear the shear member. Further increase in fluid pressure will urge the inner mandrel axially downwardly with respect to the outer mandrel. Downward movement of the inner mandrel will cause the lower engagement portion of the exercising tool to become aligned with the lower end of the flow tube and the upper engagement portion to become aligned with the upper end of the flow tube. The upper and lower engagement portions are shaped and sized to overlie and underlie, respectively, the upper and lower ends of the flow tube. In a currently preferred embodiment, the upper and lower engagement portions are provided by collets.

The flow tube of the safety valve is exercised by moving it axially upwardly and downwardly with respect to the safety valve housing. The flow tube can be moved upwardly by pulling upwardly on the running arrangement for the exercising tool. The flow tube can also be moved downwardly by increasing fluid pressure within the tubing string. An increase of fluid pressure within the production tubing string will exert fluid pressure upon a fluid pressure receiving area of the tool to urge the flow tube axially downwardly. The flow tube may be repeatedly moved up and down to clean scales and other debris from it.

The flow tube exercising tool of the present invention provides a number of advantages over conventional systems. The flow tube of the safety valve may be exercised (i.e., moved axially with respect to the safety valve housing) without the risk of damage from the setting of slips. Only a single trip of the flow tube exercising tool is necessary to accomplish multiple upward and downward movements of the flow tube. Additionally, the flow tube is exercised without the need to operate the hydraulic actuator of the safety valve.

BRIEF DESCRIPTION OF THE DRAWINGS

For a thorough understanding of the present invention, reference is made to the following detailed description of the preferred embodiments, taken in conjunction with the accompanying drawings in which like reference characters designate like or similar elements throughout the several figures of the drawing.

DETAILED DESCRIPTION OF THE PREFERRED EMBODIMENTS

Figure 1A:
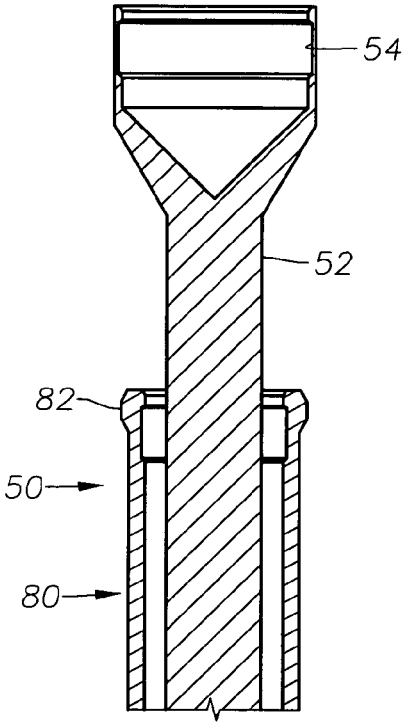
FIGS. 1A, 1B and 1C present a side, cross sectional view of an exemplary flow tube exercising tool constructed in accordance with the present invention in a position for being run into production tubing.
Figure 1B:
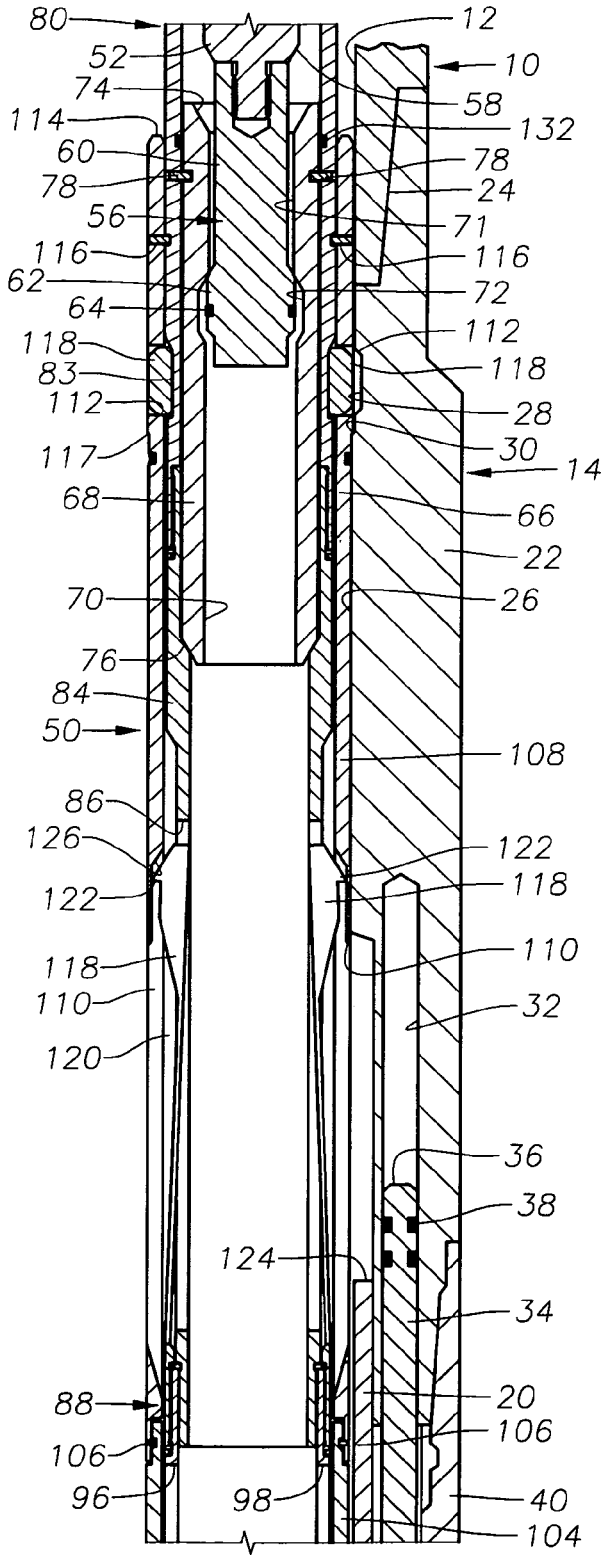
Figure 1C:
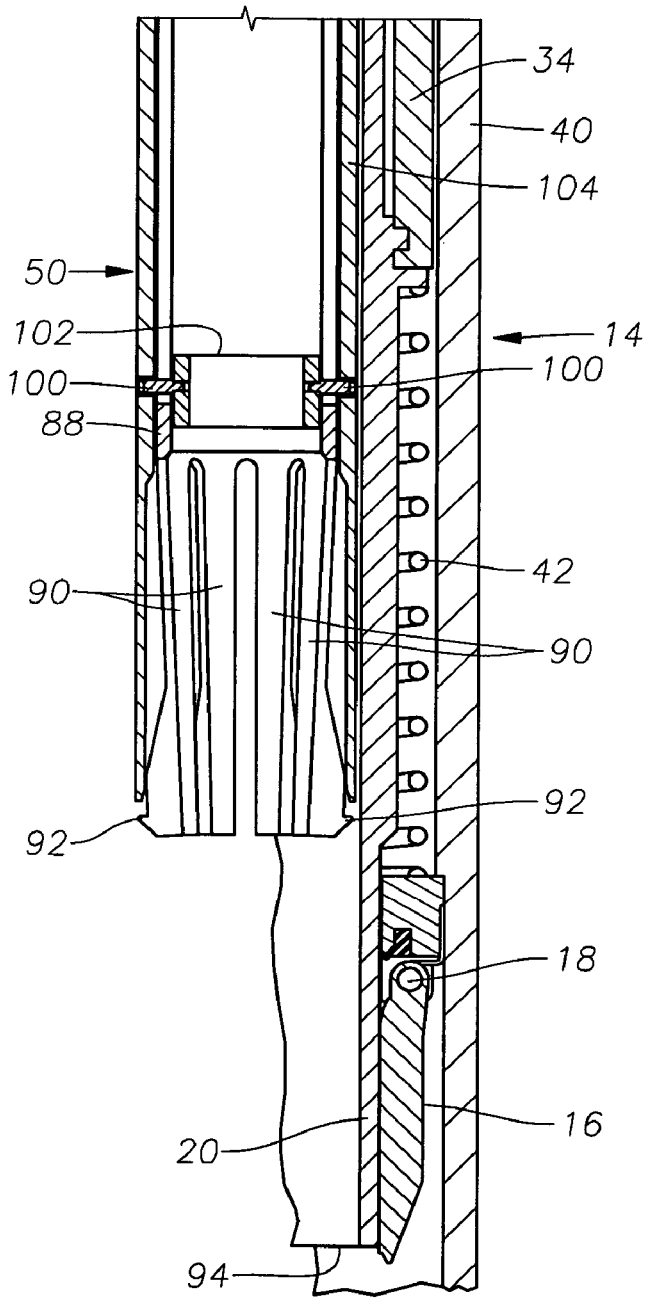

FIGS. 1A, 1B and 1C illustrate a section of portion of a string of production tubing 10, of a type known in the art that defines a production flowbore 12 along its length. A safety valve, generally indicated at 14 is integrated into the production tubing string 10. The safety valve 14 is a flapper valve, of a type that is well known in the art and described in, for example, U.S. Pat. No. 4,415,036 issued to Carmody. U.S. Pat. No. 4,415,036 is owned by the assignee of the present invention and is incorporated herein by reference. In the safety valve 14, a flapper valve member 16 rotates in a pivoting manner about a hinge 18 and is biased toward a closed position by a spring (not shown), in a manner well known in the art. The flapper member 16 is opened and retained in an open position (as illustrated in FIG. 1C) by an axially moveable flow tube 20 which, in turn, is actuated by a hydraulic piston-type controller (not shown) of a type known in the art.

At its upper end, the safety valve 14 includes a nipple adapter 22 that is secured by threaded connection 24 to the production tubing string 10. The nipple adapter 22 defines an interior axial flowbore 26 along its length, and an annular dog recess 28 is located within the flowbore 26. An upwardly directed stop shoulder 30 is also located within the flowbore 26.

The body of the safety valve 14 defines a piston chamber 32 that houses actuation piston 34. The actuation piston 34 is secured to the flow tube 20 and presents an upper pressure receiving end 36 with fluid seals 38 to form a fluid tight seal within the piston chamber 32. A hydraulic controller (not shown) of a type known in the art is interconnected with the nipple adapter 22, as is know, to provide fluid pressure to the interior of the chamber 32 in order to actuate the flapper valve 14 to an open position by axial movement of the flow tube 20. The upper pressure receiving end 36 of the piston 34 is adapted to receive increased fluid pressure. The lower end of the nipple adapter 22 is secured to a flapper valve housing 40 that encloses the flapper valve member 16 and compression spring 42.

Also shown in FIGS. 1A, 1B and 1C is a flow tube exercising tool 50 that is run into the flowbore 12 of the production tubing string 10 at the lower end of a wireline "GS" type running tool (not shown) or other suitable running arrangement of a type known in the art. Beginning at its upper end, the flow tube exercising tool 50 includes a fishing neck sub 52 having a fishing neck 54 at its upper end. The lower end of the fishing neck sub 52 is secured by threading to a fishing neck extension 56. An abutment shoulder 58 is also formed at the lower end of the fishing neck sub 52. The fishing neck extension 56 has a radially reduced body portion 60 and an enlarged body portion 62. A fluid seal 64 surrounds the enlarged body portion 62.

Radially surrounding the fishing neck extension 56 is a tubular sealing mandrel 66. The sealing mandrel 66 includes a body 68 that defines an axial passage 70 along its length. The axial passage 70 contains a reduced-diameter flow portion 71 and an enlarged diameter portion 72. The upper end of the body 68 presents a landing shoulder 74 within the passage 70 while the lower end of the body 68 presents an exterior landing shoulder 76.

The sealing mandrel 66 is releasably affixed by shear members 78 to an inner mandrel 80. The inner mandrel 80 features an enlarged head portion 82 and an exterior dog recess 83. The inner mandrel 80 is affixed at its lower end to an inner sleeve 84. The inner sleeve 84 features a set of collet windows 86 in its body.

The lower end of the inner sleeve 84 is secured to a lower collet sub 88. The lower collet sub 88 presents a number of axially extending collets 90 having latch end portions 92 that are shaped and sized to underlie the lower end 94 of the flow tube 20. The lower collet sub 88 also includes a plurality of slots 96, 98 above the collets 90. In a currently preferred embodiment, there are four slots 96, 98, which are spaced about the circumference of the lower collet sub 88 at approximate 90 degree angles from each other. Pins 100 extend through each slot 96, 98 and are secured to a ring 102 retained within the lower collet sub 88 and a lower outer sleeve 104 that radially surrounds the lower collet sub 88.

The lower outer sleeve 104 is releasably affixed by shear screws 106 to an upper outer sleeve 108. The upper outer sleeve 108 includes a set of outer collet windows 110 and a set of locking dog windows 112. The upper outer sleeve 108 terminates in an upper end 114. The upper outer sleeve 108 is releasably secured by shearable pin members 116 to the inner mandrel 80. Additionally, the upper outer sleeve 108 presents an outward and downwardly directed landing shoulder 117 that is shaped and sized to land within and contact the shoulder 30 in the nipple adapter 22. During run in, the locking dogs 118 initially reside within the locking dog slots 112 and partially within the dog recess 83 of the inner mandrel 80, as depicted in FIG. 1B.

A set of upper collets 118 are disposed generally within the radial space 120 between the inner sleeve 84 and the upper outer sleeve 108. Each of the upper collets 118 has a prong-type end portion 122 that is shaped and sized to overlie and engage the upper end 124 of the flow tube 20. The upper and lower collets 118, 90 collectively provide a mandrel body that is shaped and sized to reside within the flow tube 20 of the safety valve 14 and, as will be described, are capable of moving the flow tube 20 axially upwardly and downwardly with respect to the safety valve 14.

Both sets of collets 90 and 118 are biased radially outwardly due to shape memory, and, in the initial run-in configuration depicted by FIGS. 1A, 1B and 1C, are restrained radially inwardly by a surrounding member. In the case of the upper collets 118, the upper prong portion 122 is contacted by sloped side surfaces 126 on the upper outer sleeve 108, which cam the collets 118 radially inwardly. The lower collets 90 are retained radially inwardly by the surrounding lower end of the lower outer sleeve 104.

Figure 2A:
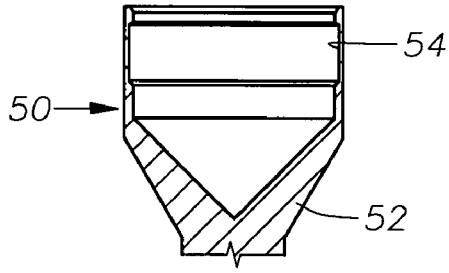
FIGS. 2A, 2B and 2C are a side, cross-sectional view of the exercising tool shown in FIGS. 1A-1C, now with the lower engagement portion of the exercising tool engaging the lower end of the safety valve flow tube and the upper engagement portion of the exercising tool engaging the upper end of the flow tube.
Figure 2B:
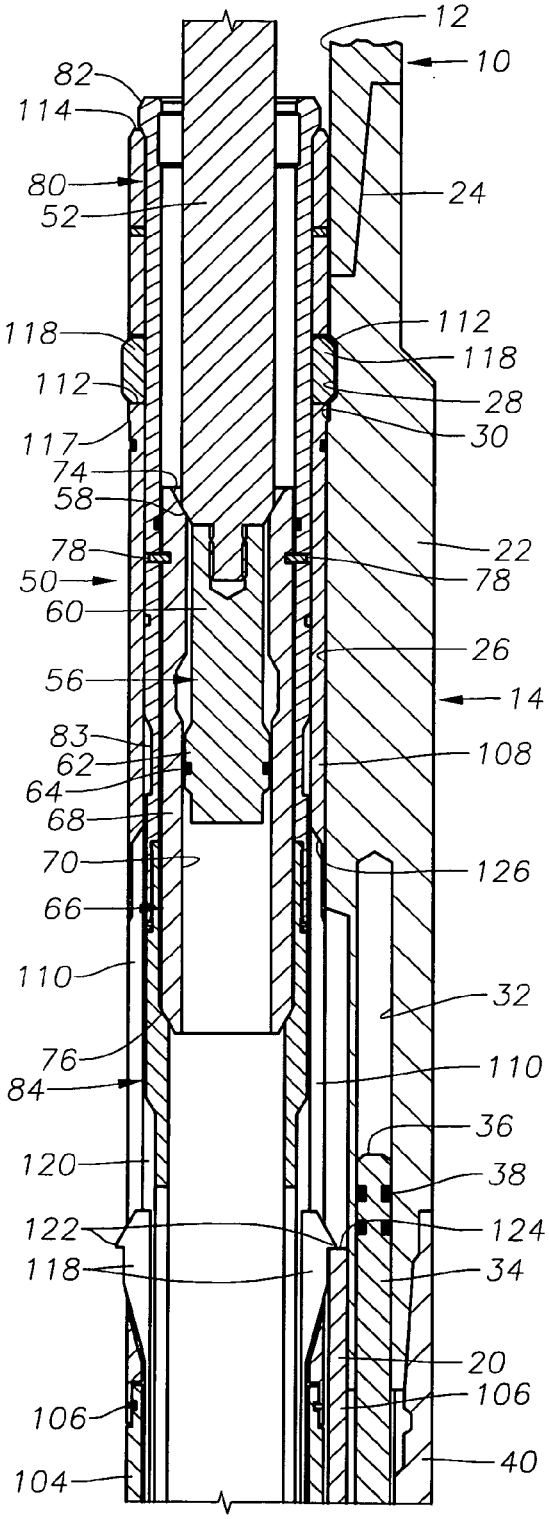
Figure 2C:
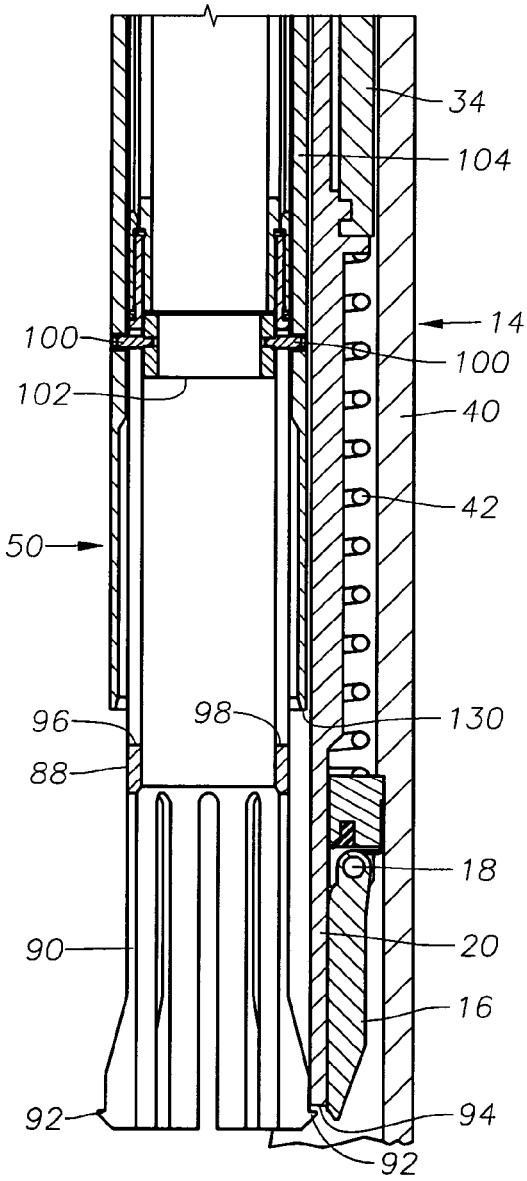

In operation, the flow tube exercising tool 50 is run down into the flowbore 12 of the production string 10, in the initial condition shown in FIGS. 1A, 1B, and 1C. FIGS. 2A, 2B and 2C illustrate the exercising tool 50 now having been landed within the nipple adapter 22 of the safety valve 14. The landing shoulder 117 of the upper outer sleeve 108 has been landed into the shoulder 30 of the nipple adapter 22. Further downward force is then applied to the upper fishing neck sub portion of the tool 50 via fluid pressure, a jarring tool, weight, or otherwise to cause the shear members 78 to shear. This will release the inner mandrel 80 from the surrounding upper outer sleeve 108. Downward movement of the inner mandrel 80 with respect to the upper outer sleeve 108 will cause the locking dogs 118 to be cammed out of the dog recess 83 of the inner mandrel and into the dog recess 28 of the nipple adapter 22, thereby securely locking the exercising tool 50 to the nipple adapter 22. The inner mandrel 80 continues to move downwardly with respect to the upper outer sleeve 108 until the enlarged head portion 82 of the inner mandrel 80 shoulders out against the upper end 114 of the upper outer sleeve 108, as depicted in FIG. 2B. In this position, the lower collets 90 will be moved to a position wherein they are not restrained by the lower outer sleeve 104. The prong ends 92 of each lower collet 90 will then underlie the lower end 94 of the flow tube 20.

Downward movement of the inner mandrel 80 with respect to the upper outer sleeve 108 will also cause the upper collets 118 to slide downwardly within outer collet windows 110. The prong portions 122 of each upper collet 118 will enter the recessed area 130 above the upper end 124 of the flow tube 20. Thus, the prong ends 122 will overlie the upper end 124.

It is further noted that, as the inner mandrel 80 is moved downwardly, the enlarged body portion 62 of the fishing neck extension 56 is moved out of the enlarged diameter portion 72 of the axial passage 70 of the sealing mandrel 66 so that the fluid seal 64 surrounding the enlarged body portion 62 will create a fluid seal against the side of the axial passage 70 (see FIG. 2B). Downward movement of the fishing neck extension 56 within the sealing mandrel 66 is limited by the landing of shoulder 58 against shoulder 74, as shown in FIG. 2B.

Figure 3A:
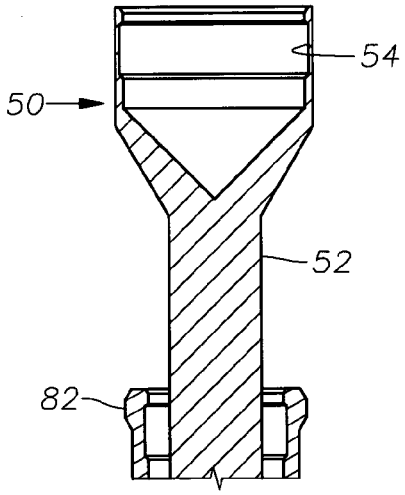
FIGS. 3A, 3B and 3C are a side, cross-sectional view of the exercising tool shown in FIGS. 1A-1C, now with the safety valve flow tube having been raised to an upper position.
Figure 3B:
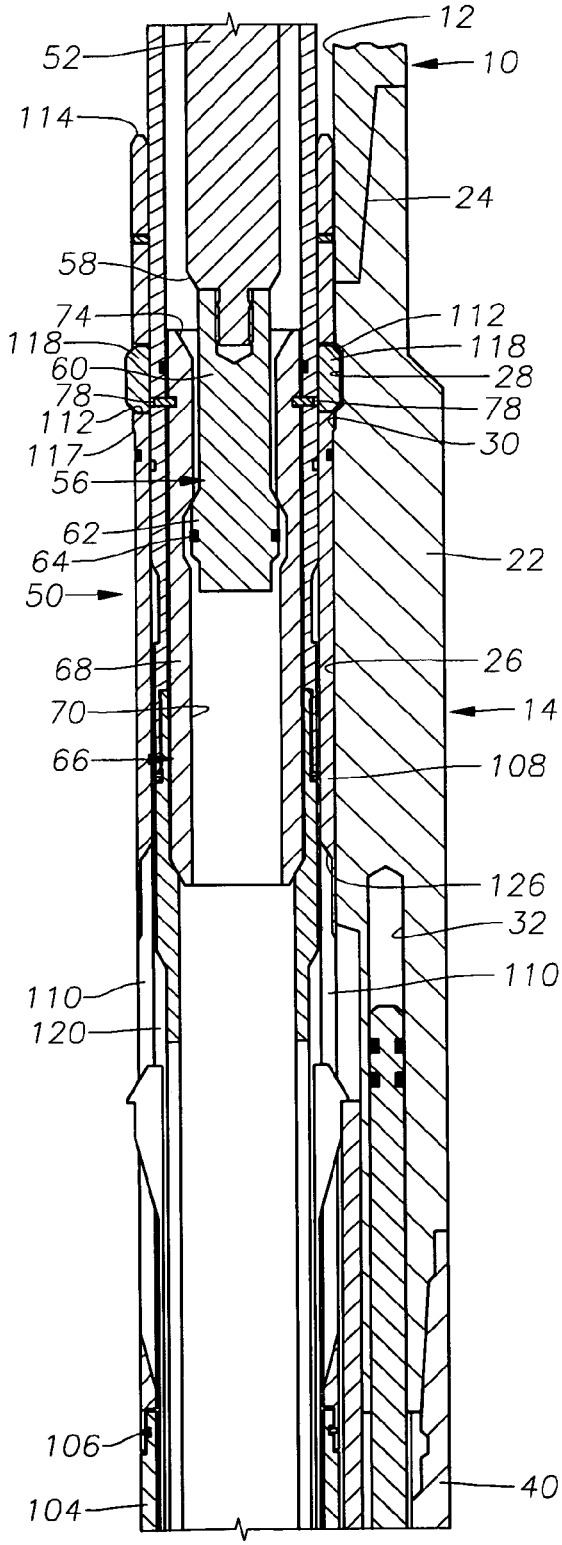
Figure 3C:
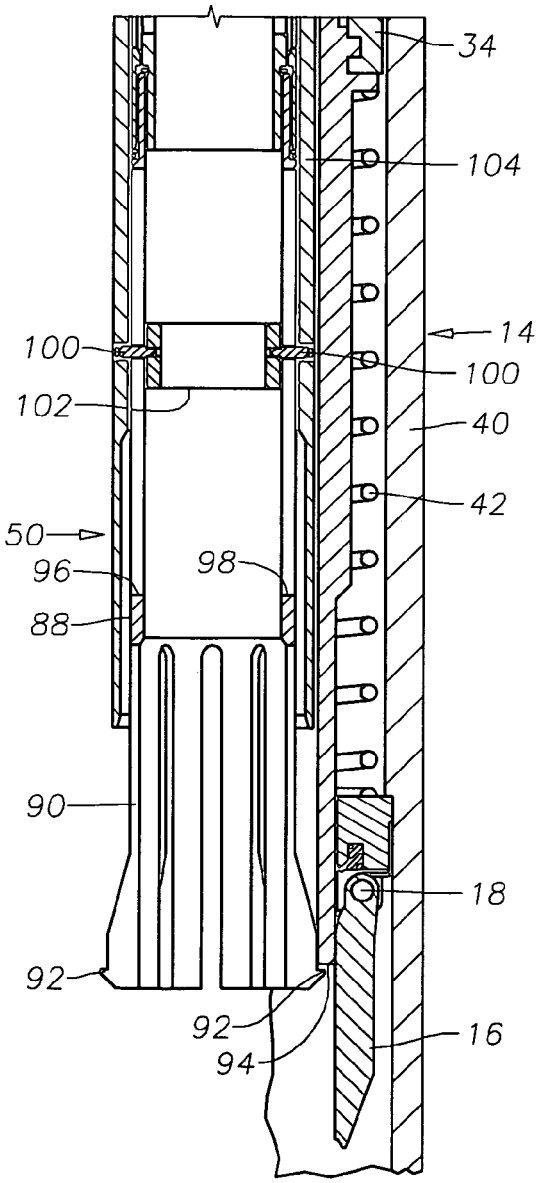

Once the exercising tool 50 has been landed into the nipple adapter 22 and safety valve 14 in the manner described above, the flow tube 20 may then be exercised by the tool 50 to move the flow tube 20 axially upwardly and downwardly with respect to the safety valve 14, thereby removing scales, paraffins, debris and other build up that might tend to preclude proper operation of the safety valve 14. To raise the flow tube 20 with respect to the safety valve 14, an operator at the surface of the well (not shown) will pull up on the running arrangement (not shown) for the exercising tool 50 which, in turn, will cause the fishing neck sub 52 and affixed fishing neck extension 56 to be raised. The enlarged body potion 62 will shoulder against the upper reduced diameter flow portion 71 of the axial passage 70 of the surrounding sealing mandrel 66 and cause the sealing mandrel 66 to be moved upwardly as well. Because the sealing mandrel 66 is affixed by pins 78 to the inner mandrel 80, the inner mandrel 80 and affixed inner sleeve 84 and lower collet sub 88 are raised as well. FIGS. 3A-3C illustrate the configuration of the exercising tool 50 with the flow tube 20 now having been raised to an upper position with respect to the safety valve 14 by virtue of the underlying relation of the prong portions 92 of lower collets 90 beneath the lower end 94 of the flow tube 20.

To return the flow tube 20 to its downward position (as depicted in FIGS. 2A-2C), fluid pressure is increased in the flowbore 12 above the exercising tool 50. The fluid pressure increase will exert force upon the upper axial ends of the fishing neck sub 52, the sealing mandrel 66, and the inner mandrel 80. By virtue of fluid seals 64 and 132 (between the inner mandrel 80 and the sealing mandrel 66), a substantially uniform pressure receiving area is created. The inner mandrel 80, sealing mandrel 66, and fishing neck sub 52 and extension 56 and upper collets 118 are all moved radially downwardly within the surrounding upper and lower outer sleeves 108, 104. It should be noted that the upper and lower outer sleeves 108, 104 collectively form a unitary outer sleeve that surrounds the inner mandrel 80 and associated components. This downward axial movement will cause the upper collets 118, whose flange portions overlie the upper end 124 of the flow tube 20, to urge the flow tube 20 axially downwardly. The upper collets 118 are capable of movement within the collet windows 110 for movement of the flow tube 20 while the outer sleeves 104, 108 remain securely locked to the nipple adapter 22.

The procedures described above for movement of the flow tube 20 upwardly and downwardly with respect to the safety valve 14 may be repeated as necessary in an alternating manner to remove scale and other debris and ensure proper operation of the safety valve 14. Movement of the flow tube 20 may be exercised in this manner using only a single trip of the exercising tool 50 into the production tubing 10. However, the exercising tool 50 may also be run into the production tubing 10 on several separate occasions during the life of the wellbore to ensure continued proper operation of the safety valve 14 throughout.

Normally, the exercising tool 50 may be detached from the flow tube 20 by merely pulling upwardly on the running arrangement with sufficient force that the lower collets 90 are deflected radially inwardly and thus released from the lower end 94 of the flow tube 20. Further upward pulling of the running arrangement will cause the fishing neck sub 52, fishing neck extension 56, sealing sub 66, inner mandrel 80, inner sleeve 84 and lower collet sub 88 and affixed outer sleeves 104, 108 to be moved axially upwardly. The locking dogs 112 will retract back into the dog recess 83 of the inner mandrel 80, thereby freeing the exercising tool 50 from locking engagement with the safety valve 14. At this point, the exercising tool 50 is withdrawn from the safety valve 14 and from the tubing string 10.

Figure 4:
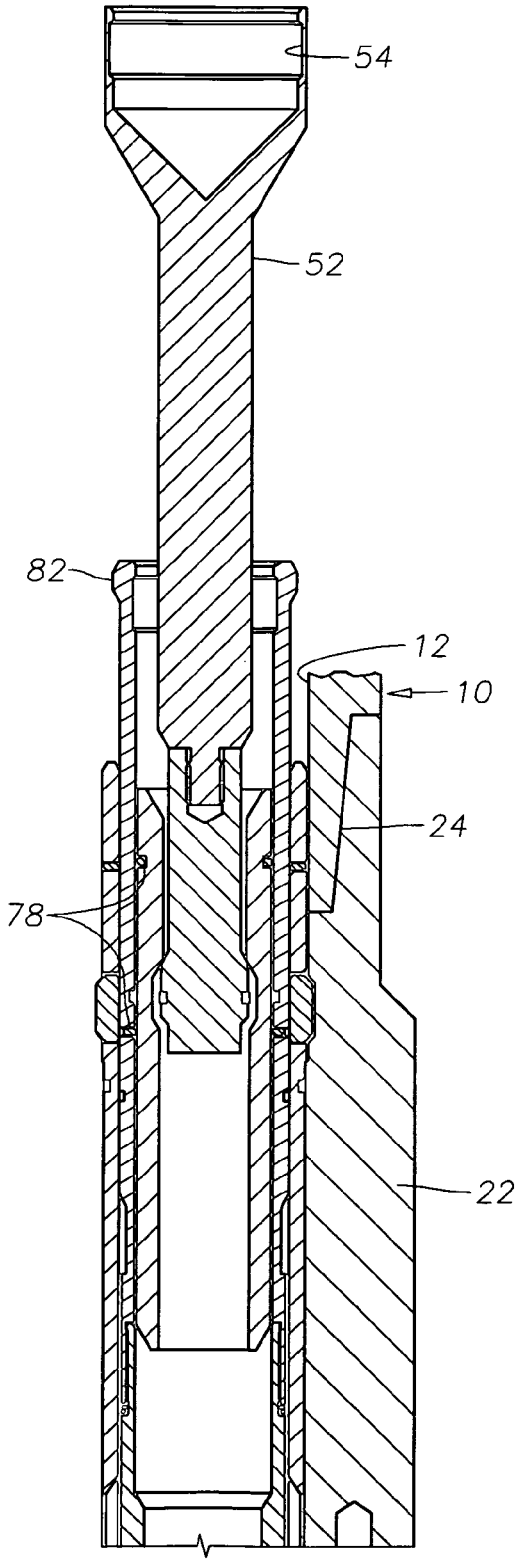
FIG. 4 is a side, cross-sectional view of the upper portion of the exercising tool now with the emergency release feature activated.

If, however, the exercising tool 50 cannot be detached in this manner, the tool 50 may be released using a technique for emergency disengagement of portions of the tool 50 from the safety valve 14. An operator at the surface (not shown) will apply an upward pull on the fishing neck sub 52 that is sufficient to shear the pins 78 that are securing the sealing mandrel 66 to the inner mandrel 80. Further upward pulling will remove the fishing neck sub 52, fishing neck extension 54 and sealing mandrel 66 from the exercising tool 50 and then from the production tubing 10 (see FIG. 4). With these components removed, a fishing tool (not shown) of a type known in the art may be inserted into the production tubing 10 and used to engage the enlarged head portion 82 of the inner mandrel 80 and remove it from the valve 14 and tubing string 10 as well. A further release tool (not shown), such as a standard sinker bar or weight, may subsequently be run into the tubing string 10 and used to contact the ring 102 to urge these additional components out of engagement with the surrounding valve 14. The release tool will be effective to release the lower collets 90 from the lower end 94 of the flow tube 20 because downward urging of the ring 102 will cause shifting members, or pins, 100 to slide downwardly within slots 96, 98 in the lower collet sub 88. The shifting members 100 are affixed to the lower outer sleeve 104 and will cause the lower end 130 of the lower outer sleeve 104 to wedge between the lower collets 90 and the flow tube 20, thereby forcing disengagement.

Those of skill in the art will recognize that numerous modifications and changes may be made to the exemplary designs and embodiments described herein and that the invention is limited only by the claims that follow and any equivalents thereof.

What is claimed is:

1. A safety valve flow tube exercising tool for providing axial movement of a flow tube within a flapper-type safety valve, the tool comprising:

a mandrel body shaped and sized to reside within the flow tube of a flapper-type safety valve;

a lower engagement portion on the mandrel body shaped and sized to underlie a lower end of the flow tube so that upward movement of the mandrel body will move the flow tube axially upwardly within the safety valve; and an upper engagement portion on the mandrel body shaped and sized to overlie an upper end of the flow tube so that downward movement of the mandrel body will move the flow tube axially downwardly within the safety valve.

2. The safety valve flow tube exercising tool of claim 1 further comprising a locking member for securing the exercising tool to a portion of the safety valve.

3. The safety valve flow tube exercising tool of claim 1 wherein the lower engagement portion comprises a collet having an outwardly projecting flange to underlie a lower end of the flow tube.

4. The safety valve flow tube exercising tool of claim 1 wherein the upper engagement portion comprises a collet having an outwardly projecting flange to overlie an upper end of the flow tube.

5. The safety valve flow tube exercising tool of claim 1 wherein the exercising tool further comprises an outer sleeve portion that is selectively securable to a portion of a safety valve within a production tubing string.

6. The safety valve flow tube exercising tool of claim 5 wherein the inner mandrel and outer sleeve portion are releasably secured to one another by a shear member.

7. A system for exercising a flapper-type safety valve having an actuating flow tube, the system comprising:

a running tool;

a safety valve flow tube exercising tool secured to the running tool, the exercising tool comprising:

a lower engagement portion shaped and sized to underlie a lower end of the flow tube so that upward movement of the lower engagement portion will move the flow tube axially upwardly within the safety valve; and an upper engagement portion shaped and sized to overlie an upper end of the flow tube so that downward movement of the upper engagement portion will move the flow tube axially downwardly within the safety valve.

8. The system of claim 7 further comprising a locking dog member that selectively secures a portion of the exercising tool to a portion of the safety valve.

9. The system of claim 7 further comprising a release tool that is run into the exercising tool to release the lower engagement portion of the exercising tool from the flow tube.

10. The system of claim 7 wherein the exercising tool further comprises an inner mandrel and a radially outer sleeve portion that are releasably secured to one another.

11. The system of claim 7 wherein the upper and lower engagement portions each comprise a collet having an outwardly projecting flange.

12. A method of exercising a safety valve within a wellbore comprising the steps of:

disposing an exercising tool into a safety valve having a flapper element and a flow tube for selectively opening the flapper element;

disposing an lower engagement portion of the exercising tool beneath a lower end of the flow tube;

disposing an upper engagement portion of the exercising tool above an upper end of the flow tube;

raising the lower engagement portion to raise the flow tube within the safety valve to an upper position; and lowering the upper engagement portion to lower the flow tube to a lower position.

13. The method of claim 12 further comprising the step of locking the exercising tool into the safety valve.

14. The method of claim 13 wherein the step of locking the exercising tool into the safety valve comprises setting a locking dog into a dog recess in the safety valve.

15. The method of claim 12 further comprising the step of releasing the exercising tool from the flow tube.

16. The method of claim 15 wherein the step of releasing the exercising tool from the flow tube comprises pulling upwardly on the exercising tool to cause the engagement portion to disengage from the flow tube.

17. The method of claim 15 wherein the exercising tool is released from the flow tube by a release tool.

18. The method of claim 17 wherein the releasing tool moves a shifting member to urge the lower engagement portion out of engagement with the flow tube.

* * * * *